United States Patent [19]

Siegel et al.

[11] 4,089,472

[45] May 16, 1978

[54] IMPACT TARGET FOR FLUID ENERGY MILLS

[75] Inventors: Harris T. Siegel; James R. Olson, both of Rochester, N.Y.

[73] Assignee: Eastman Kodak Company, Rochester, N.Y.

[21] Appl. No.: 790,639

[22] Filed: Apr. 25, 1977

[51] Int. Cl.[2] ..... B02C 19/06

[52] U.S. Cl. ..... 241/5; 241/40

[58] Field of Search ..... 241/5, 39, 40, 43, 45, 241/152 R

[56] References Cited

U.S. PATENT DOCUMENTS

| | | | |
|---|---|---|---|
| 2,072,492 | 3/1937 | Anger | 241/40 |
| 2,666,632 | 1/1954 | Culver et al. | 241/40 |
| 2,765,122 | 10/1956 | Trost | 241/40 |
| 3,895,760 | 7/1975 | Snyder | 241/5 |

*Primary Examiner*—Granville Y. Custer, Jr.
*Attorney, Agent, or Firm*—Ogden H. Webster

[57] ABSTRACT

An impact target for a fluid energy mill comprises a plurality of impact plates arranged in series in spaced relationship alone and generally perpendicular to the axis of a discharge conduit. All but one of the plates has an open area in the central portion thereof and an impact area surrounding the open area. The size of the open area diminishes with the distance of the plate from the discharge conduit.

7 Claims, 11 Drawing Figures

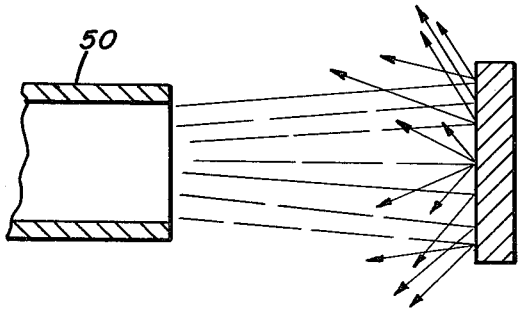
PRIOR ART
FIG. 5a
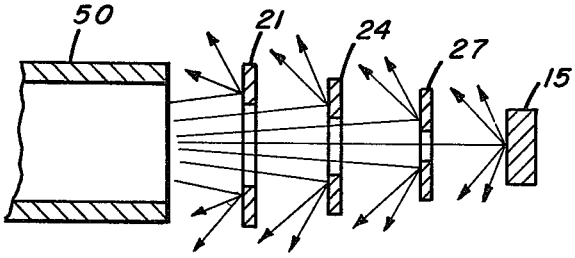
FIG. 5b
FIG. 6
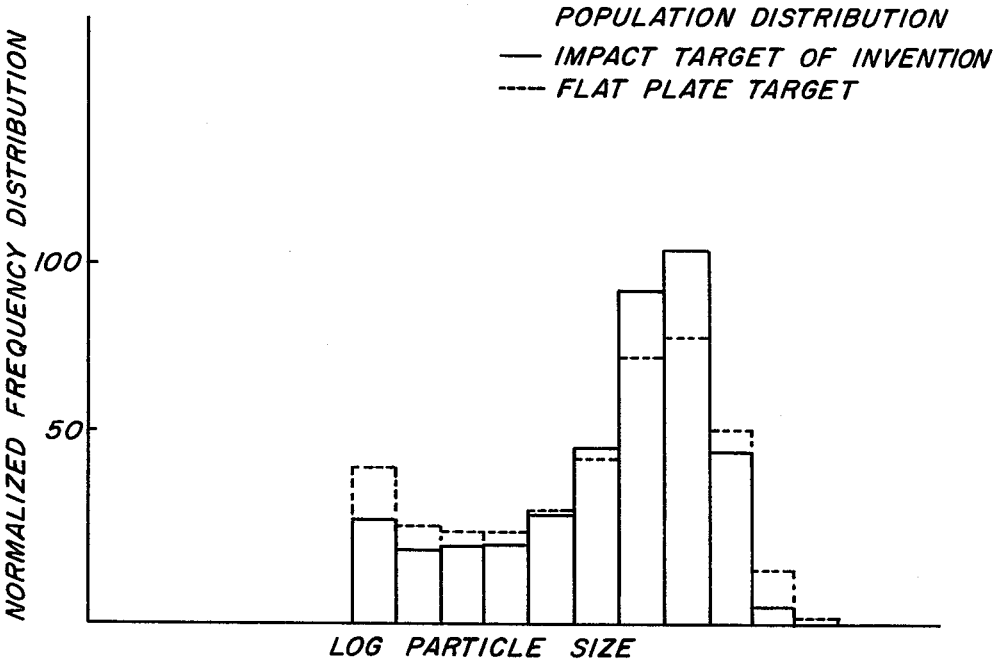

IMPACT TARGET FOR FLUID ENERGY MILLS

FIELD OF THE INVENTION

This invention relates to the grinding of solid material by jet impact, and particularly to impact targets against which particles of the solid material are projected for comminution.

DESCRIPTION OF THE PRIOR ART

Fluid energy mills for the very fine grinding of solids are well known. Such mills have been described in, for example, U.S. Pat. Nos. 2,072,492; 2,934,276; 2,949,245; 3,005,594; 2,932,458; 2,753,123; 2,765,122; 2,991,946; 3,482,786; and 3,701,484; etc. The solid particles are ground by entraining them in a stream of fluid, generally a gaseous fluid, and projecting them through a conduit (often referred to as a gun barrel) to impact against a target or against another stream of particles projected from a second conduit. The particles are generally projected through the conduit by means of a jet nozzle located in the conduit. Various targets have been used for impacting the solid particles. Commonly used targets include a flat plate, a basket of steel balls, a field of stationary rods oriented transverse to the direction of fluid flow, and the like. Generally, when more than one conduit is used to project a stream of particles, the streams are projected against one another so that the particles are ground by impacting against particles in the opposing stream. Multiple conduit fluid energy mills are generally desirable in operations where high output rates are demanded.

Such prior art devices are generally satisfactory for grinding average materials to fine particle size. However, such devices have not been entirely satisfactory for grinding materials such as electrographic toners where a narrow particle size range is desired for the product. The problems generally come from the production of too many fines, i.e., particles smaller than desired. Generally, the number of large particles can be controlled by proper setting of the classification parameters incorporated into typical fluid energy mills. When too many fines are produced, the product must be classified or sieved to remove the fines, thus necessitating an extra processing step and creating waste that must be recycled where reusable or discarded. Thus it is desirable to discover grinding conditions or apparatus that will allow more efficient grinding of solid particles into a narrow particle size range product.

Maintaining a relatively narrow particle size distribution for product while maintaining efficient grinding conditions and high throughput rates is a problem when scaling-up grinding equipment for production. We have found that such scale-up of grinding equipment is not straightforward and simple. Bench top and laboratory size fluid energy mills generally have single discharge conduits which impact particles on a flat surface or on the surface of steel balls contained in a basket. Pilot plant scale fluid energy mills that operate at feed rates about 7× to 10× greater than the laboratory equipment and production scale fluid energy mills that operate at even greater feed rates generally have multiple discharge conduits.

Typical large scale fluid energy mills have two discharge conduits that are aligned to discharge particles from one conduit against particles from the other conduit so that the particles are comminuted by impacting with other particles. We have found that in scaling up such grinding equipment for comminuting sensitive materials such as, for instance, electrographic toners, we could not maintain expected grinding efficiencies and obtain the desired narrow particle size distribution.

We have found that in scaling up from laboratory equipment to pilot plant equipment comminuting particles by discharging them through opposing conduits did not achieve the desired narrow particle size distribution for product at reasonable feed rates. Feed rates were increased, while maintaining the desired particle size distribution for product, by placing a flat plate between the discharge conduits so that particles from each conduit impacted against a hard flat surface.

When scaling up to production size equipment, we again found that we obtained less than the expected increase in feed rate in order to maintain the desired particle size distribution for product, even when using a flat plate as a target between the discharge conduits. However, a 23% increase in feed rate, while maintaining the desired narrow particle size distribution for product, was realized by substituting an impact target in accord with the present invention for the flat plate target between the discharge conduits.

SUMMARY OF THE INVENTION

This invention provides an impact target for fluid energy mills that enables the production of a narrow particle size range product with low quantities of fines at high throughput rates. The impact target of this invention is a device for use in a fluid energy mill having at least one discharge conduit with a discharge area for projecting solid particles carried in a stream of fluid against the target. The target comprises a plurality of impact surfaces in series in spaced relationship along and generally perpendicular to the axis to the discharge conduit. Each impact surface has a relatively flat, solid impact area against which at least a portion of the particles impact for comminution. All but one of the impact surfaces have an open area in the central portion of the surface about the axis to allow a portion of the particles to pass through said open area to impact on a subsequent impact surface. The sum of the impact area from each impact surface should be approximately equal to the discharge area of the conduit so that all of the particles will impact on an impact surface.

The present invention further provides a method for comminuting particles of a solid material, said method comprising discharging the particles carried in a stream of fluid through a conduit to impact against a series of impact surfaces, the impact surfaces being constructed and arranged so that each impact surface reduces the area for flow of the stream carrying said particles, thus causing a portion of said particles to impact on each impact surface for comminution.

The term "impact area" as used herein defines the area on an impact surface in which particles strike the impact surface. Because of the high fluid velocities used in fluid energy mills the discharge area of a conduit is essentially the same as the cross-sectional area of the conduit, although some slight divergence of the discharge stream may be found.

BRIEF DESCRIPTION OF THE FIGURES

FIG. 5*a* is a schematic illustrating the path of particles discharged from a conduit impacting against a flat plate target.

FIG. 5*b* is a schematic illustrating the path of particles discharged from a conduit impacting against an impact target in accord with the present invention.

FIG. 6 is a graph showing the particle size distribution of product comminuted using a flat plate target compared with that comminuted using an impact target of the invention.

DETAILED DESCRIPTION OF THE INVENTION

Figure 1:
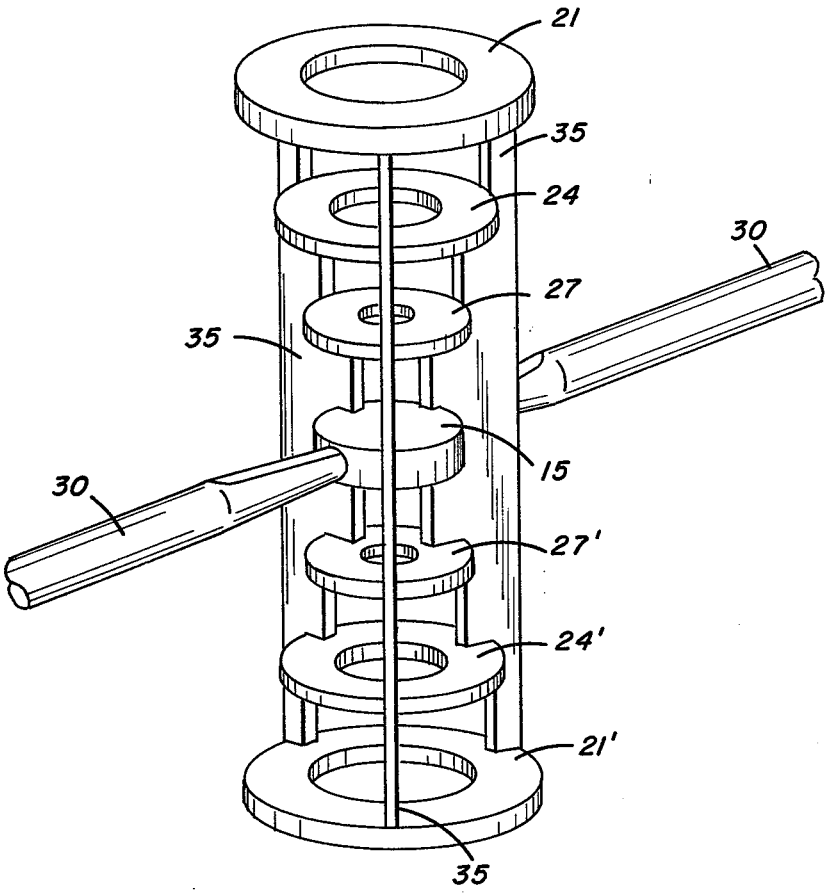
FIG. 1 is a perspective view of an impact target in accord with the invention.
Figure 2:
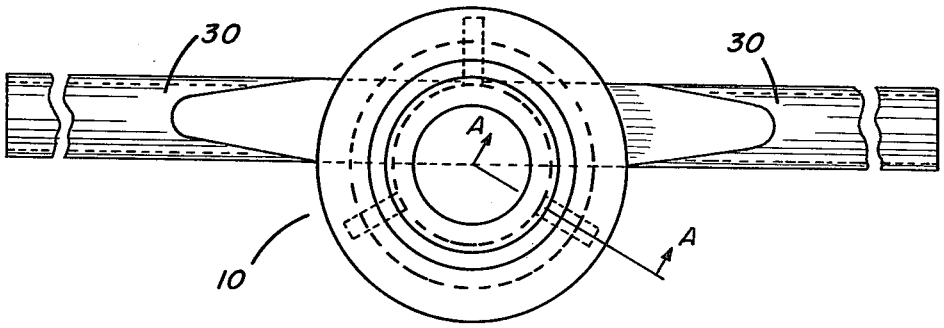
FIG. 2 is a top view of the impact target of FIG. 1 with the centerline of the mounting rods offset from the centerline of the target.
Figure 3:
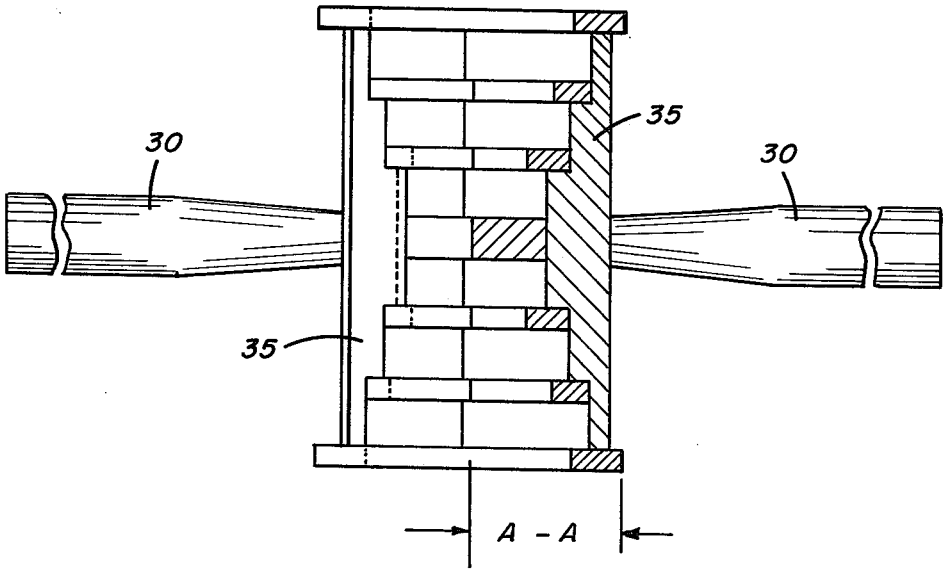
FIG. 3 is a side view of the impact target illustrating a partial section taken along line AA of FIG. 2.

One embodiment of an impact device in accordance with the present invention is illustrated in FIGS. 1 through 3. The impact device illustrated in FIG. 1 is designed for use between two opposing discharge conduits. It will be readily apparent to those skilled in the art that the principles of this invention can be used to design targets for fluid energy mills having any number of discharge conduits.

The impact target 10 has a plurality of impact surfaces (or plates) which are conveniently circular in shape. The shape of the impact surfaces is not cirtical and can take any convenient geometric form, for example, a square or a triangle, etc. The impact target 10 has a center plate 15 and six annular plates spaced apart along an axis generally perpendicular to the center plate 15. The impact target 10 is mounted in a fluid energy mill between two opposing discharge conduits (not shown) using supporting memebers 30 that are fixed to the center plate 15. The supporting members shown in FIG. 2 are offset from the center line for convenience only. The supporting members can be positioned and attached to the impact target in any alternate manner that does not interfere substantially with the fluid flow. The impact target 10 is aligned in the fluid energy mill so that the axis perpendicular to the center plate 15 is approximately on the center line of the two opposing conduits. Each of the annular plates has an impact area on the surface facing the discharge conduit and an open area generally in the central portion of the impact area.

The outermost annular plate 21, 21' has an outer diameter at least as big as the diameter of the discharge conduit and has an open area that is smaller than the cross-sectional area of the discharge conduit. Generally the diameter of the outermost annular plate will be somewhat larger than the diameter of the discharge conduit so that some misalignment in assembly would be accommodated. The relatively flat, solid section of plate 21 (21') that surrounds the open area and faces the discharge conduit is the impact area. Thus a portion of the particles discharged by the conduit will impact on the solid impact area of the annular plate 21 (21') and a portion of the particles will flow through the open area.

The next annular plate 24, 24' has an outer diameter at least as big as the open area of plate 21 (21') and has an open area that is smaller than the open area of plate 21 (21'). The solid section of plate 24 (24') surrounding the open area is the impact area. Of the particles flowing through the open area of plate 21 (21'), a portion of the particles will impact on the solid impact area of plate 24 (24') while the remaining portion will flow through the open area of plate 24 (24').

The next annular plate 27, 27' has an outer diameter at least as big as the open area of plate 24 (24') and has an open area that is smaller than the open area of plate 24 (24'). The solid section of plate 27 (27') surrounding the open area is the impact area. Of the particles flowing through the open area of plate 24 (24'), a portion of the particles will impact on the solid impact area of plate 27 (27') while the remaining portion will flow through the open area of plate 27 (27').

All of the particles that flow through the open area of plate 27 (27') will impact on the center plate 15. The diameter of the center plate 15 is at least as big as the open area of plate 27 (27').

The impact target 10 is assembled using three spacing members 35 approximately equally spaced around the circumference of the impact plates. The members 35 are attached to and support the impact plates and hole them in fixed relation with each other. The distance between the impact plates is not critical but should be sufficient to allow the fluid carrying particles that impact against a plate to escape between the plate and its preceding plate without interfering with the fluid flow through the open area.

Figure 4A:
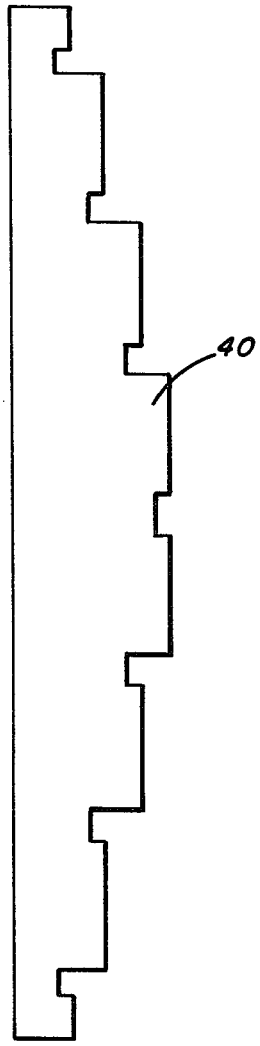
FIG. 4*a* illustrates a preferred spacing member.
Figure 4B:
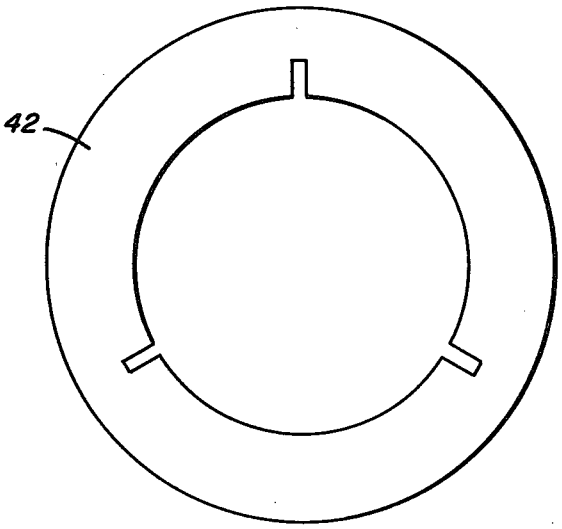
FIG. 4*b* illustrates a retaining ring.
Figure 4C:
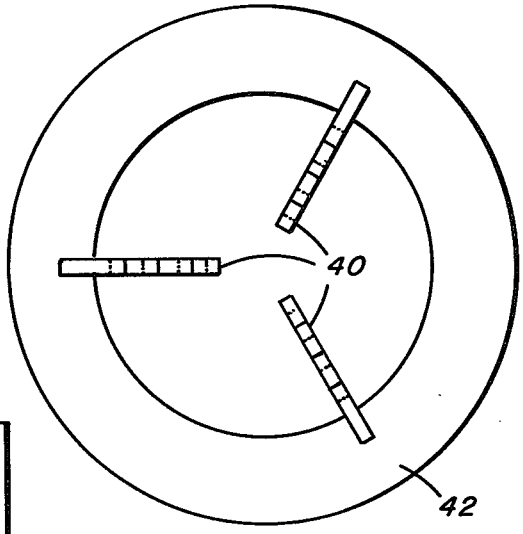
FIG. 4*c* is a top view illustrating the assembly of 3 spacing members and two retaining rings.
Figure 4D:
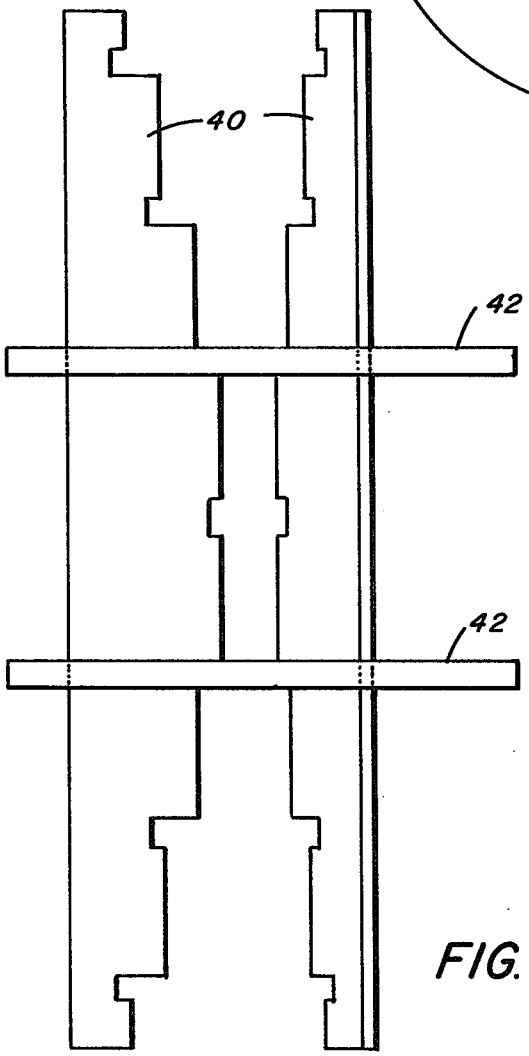
FIG. 4*d* is a side view illustrating the assembly of FIG. 4*c*.

A preferred assembly of an impact target is illustrated by FIGS. 4*a* -4*d*. A spacing member 40 is notched to accept the impact plates. Three spacing members 40 are arranged around the impact plate and a retaining ring 42 is positioned around the arrangement to complete the assembly. FIGS. 4*c* and 4*d* illustrate a top view and a front view, respectively, of such an assembly without the impact plates being shown.

In operation the impact target 10 is mounted between opposing conduits in a fluid energy mill using mounted rods 30. FIG. 5*a* is a schematic illustrating what happens to particles discharged from a conduit 50 to impact on a standard flat plate target and FIG. 5*b* illustrates impact on a target in accord with the present invention. The lines emanating from the conduit 50 depict the path of particles being projected toward the impact surface. Upon impact each particle will be shattered into two or more smaller particles. As can be observed the impact target of the present invention reduces the likelihood that small particles produced by a first impact with the target surface will collide with a particle that has not impacted on the target surface.

The open areas of the impact plates of impact targets in accord with this invention are arranged so that the outermost plate has the largest open area, and the open area of each next adjacent plate is smaller until the center plate, that has no open area, is reached. Conveniently, the open area or the diameter of the opening of each successive plate is reduced by a fixed percentage of the open area (or diameter) of the immediately preceding plate or is reduced by fixed percentage of the cross-sectional area (or diameter) of the conduit. For example, the open area of each succeeding plate could be reduced say 25% from that of the preceding plate or the diameter of the open area of each succeeding plate could be reduced 25% from that of the preceding plate. Alternatively, the open area or diameter of each succeeding plate could be reduced in say 25% increments based on the cross-sectional area or diameter, respectively, of the discharge conduit. The method for reducing the open area from plate to plate is not critical.

Among the benefits derived by using an impact target of the present invention in a fluid energy mill is that, when other operating conditions are kept constant, a narrower particle size distribution having fewer fine particles is obtained with the impact target of this invention. In FIG. 6, the solid bars show the particle size distribution obtained using an impact target of the present invention (as illustrated by the sketch in FIG. 5*b*) and the dashed lines show the particle size distribution obtained using a flat plate target (as illustrated by sketch in FIG. 5*a*).

Figure 7:
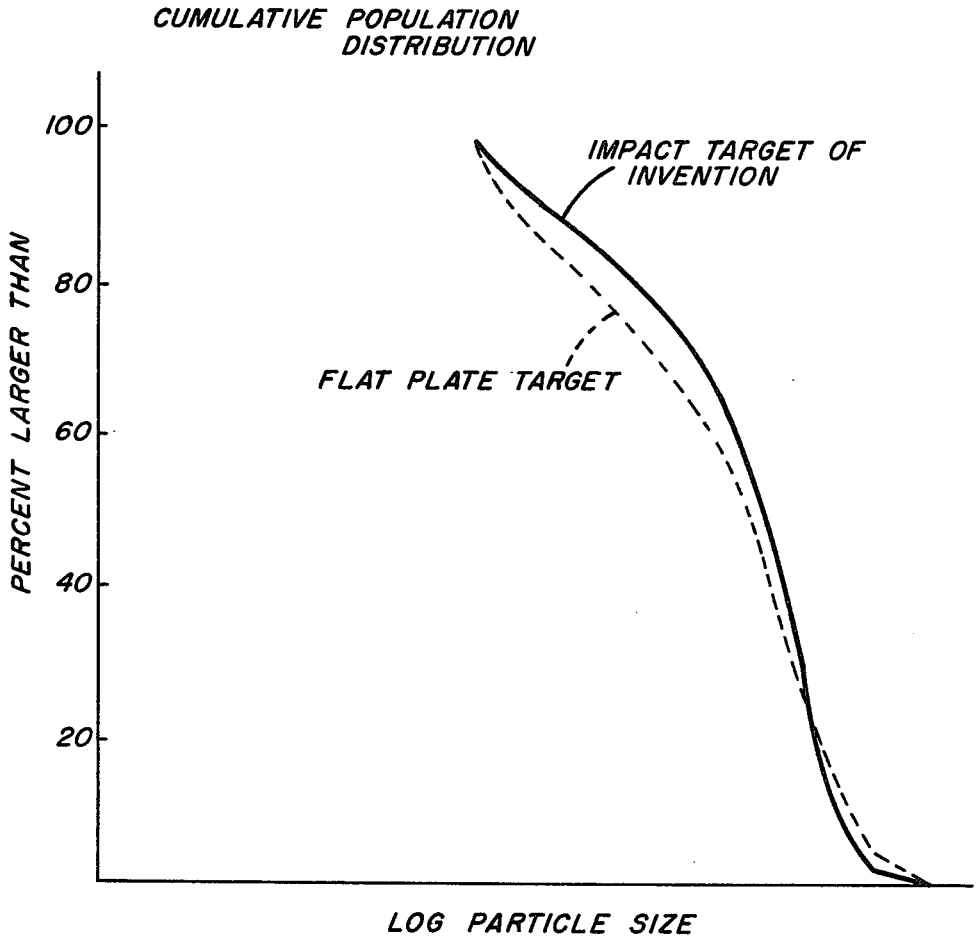
FIG. 7 is a graph of the cumulative population distribution of the data presented in FIG. 6.

FIG. 7 shows the same data as presented in FIG. 6, only presented as the cumulative percent of particles larger than a given size. A steeper slope is an indication of a narrow particle size distribution. We have found that as one increases the feed rate of the fluid energy mill, thereby causing an increase in the concentration of particles in the discharge conduit, the particle size distribution of the product, presented in the form illustrated in FIG. 7, will shift to the left. Thus, if the dashed line is illustrative of acceptable product, the feed rate can be increased when using the impact target of this invention until the solid line shifts as far left as the dashed line. Using this criterion we have found that increases in feed rates on the order of from 20 to 25% can be obtained when grinding toner particles using an impact target of this invention instead of a flat plate target.

This invention has been illustrated by describing an impact target having three impact plates with open areas on either side of a center plate. It will be obvious to those skilled in the art that impact targets having more or less plates are also useful for practicing this invention. The number of plates selected will depend upon the material being comminuted and the desired results.

The invention has been described in detail with particular reference to certain preferred embodiments thereof, but it will be understood that those skilled in the art can effect variations and modifications within the spirit and scope of the invention. For instance, one could construct and arrange impact plates of any geometric shape in series so that a portion of each plate projects into the stream of particles being discharged from a nozzle thus decreasing the area of flow and causing a portion of the particles to impact on each plate. Thus, symmetry of the impact area of an impact plate is not necessary nor even desired for practicing the present invention. Such symmetry is only convenient for the construction of impact targets. Any such arrangements that embody the gist of the invention are considered equivalent to the embodiment of the invention described herein.

We claim:

1. An impact device for comminuting solid particles of a material carried in a fluid stream in a fluid energy mill, said device comprising a plurality of impact surfaces in spaced relationship along and generally perpendicular to a central axis, at least one of such impact surfaces having an open area within the peripheral boundaries of the surface to allow a portion of the particles in the stream to pass through the open area while the remaining particles impact on the surface, the next adjacent impact surface having an impact area constructed and located so that at least a portion of the particles that passed through said open area impact on said adjacent impact surface.

2. An impact device for comminuting particles of a material carried in a stream of fluid in a fluid energy mill, said device comprising a plurality of impact surfaces aligned in spaced relationship along and generally perpendicular to a central axis; one impact surface being a relatively flat, solid surface having a first impact area against which at least a portion of said particles impact for comminution; and at least one other impact surface having an impact area that surrounds an open area within the boundary of the surface to allow a portion of the particles to pass through said open area to impact on said one impact surface while at least some of the remaining particles impact on the impact area of said one other impact surface, the total area defined by summing the impact area of the combined impact surfaces being sufficient to allow substantially all of said particles to impact on an impact area.

3. A fluid energy will be comminuting particles of a solid material by impact against an impact target, said fluid energy mill having means for projecting said particles against said impact target, said means comprising at least one conduit with a discharge area of sufficient size to accommodate a flow of said particles, wherein said impact target comprises:

a plurality of impact surfaces aligned in spaced relationship along and generally perpendicular to a central axis;

one impact surface being a relatively flat, solid surface having a first impact area against which at least a portion of said particles impact for comminution;

and at least one other impact surface having an impact area and an open area within the boundary of the surface to allow a portion of the particles to pass through said open area to impact on said one impact surface while at least some of the particles impact on the impact area of said one other impact surface, the total impact area defined by summing the impact area of each impact surface being approximately equal to the discharge area of said conduit that is projecting particles at said impact surfaces.

4. A fluid energy mill for comminuting particles of a solid material by impact against an impact target, said fluid energy mill having means for projecting said particles against said impact target, said means comprising at least one conduit with a discharge area of sufficient size to accommodate a flow of said particles, wherein said impact target comprises:

a plurality of impact plates aligned in spaced relationship along and generally perpendicular to a central axis common to said impact plates and said conduit, each impact plate having an impact area against which a portion of the particles impact for comminution;

the impact plate farthest from said conduit having a relatively flat, solid surface defining an impact area;

at least one impact plate located between said conduit and said impact plate farthest from said conduit, said one impact plate having an open area in the central part of the plate to allow a portion of said particles to flow through said one impact plate and having an impact area surrounding said open area against which at least a portion of said particles impact for comminution.

5. The fluid energy mill as described in claim 4 wherein said one impact plate has an annular shape defining said open area and said impact area surrounding the open area.

6. The fluid energy mill as described in claim 4 wherein said impact target comprises three impact plates located between said conduit and said impact plate farthest from said conduit, each of said three impact plates having an annular shape defining an open area and an impact area surrounding the open area, the open area of each plate being smaller than open area of the next adjacent plate closer to said nozzle.

7. A method for comminuting particles of a solid material, said method comprising discharging the particles carried in a stream of fluid through a conduit to impact against a plurality of impact surfaces arranged in series, the plurality of impact surfaces being constructed and arranged so that each of said plurality of impact surfaces reduces the area for flow of the stream carrying said particles, thus causing a portion of said particles to impact on each impact surface for comminution and causing all of the remaining portion of said particles to impact on a last solid impact surface perpendicular to the stream of fluid.

* * * * *